United States Patent [19]

Rossetti

[11] 4,325,779

[45] Apr. 20, 1982

[54] METHOD FOR SHAPING AND FINISHING A WORKPIECE

[75] Inventor: James J. Rossetti, Palmyra, Wis.

[73] Assignee: Beatrice Foods Co., Chicago, Ill.

[21] Appl. No.: 207,826

[22] Filed: Nov. 17, 1980

Related U.S. Application Data

[63] Continuation-in-part of Ser. No. 30,802, Apr. 17, 1979, abandoned.

[51] Int. Cl.[3] ..... C23F 1/02

[52] U.S. Cl. ..... 156/651; 134/38; 156/661.1; 156/658; 427/277

[58] Field of Search ..... 156/639, 645, 658, 659.1, 156/59, 650, 651; 134/38, 40; 427/271, 277, 278; 252/79.2; 101/32

[56] References Cited

U.S. PATENT DOCUMENTS

| | | | |
|---|---|---|---|
| 681,727 | 9/1901 | Offenbacher | 156/659.1 X |
| 1,709,327 | 4/1929 | Spalding et al. | 156/651 |
| 1,903,778 | 4/1933 | Conroy | 156/651 |
| 1,991,697 | 2/1935 | Powers | 156/651 |
| 2,026,603 | 1/1936 | Zarse | 156/651 |
| 2,032,771 | 3/1936 | Scherer | 156/651 |
| 2,888,335 | 5/1959 | Atkins, Jr. et al. | 156/651 |
| 3,380,864 | 4/1968 | Broderick | 156/661.1 X |
| 3,579,394 | 5/1971 | Nelson | 156/658 |
| 4,113,549 | 9/1978 | Brimm | 156/661.1 X |

*Primary Examiner*—William A. Powell

*Attorney, Agent, or Firm*—Cook, Wetzel & Egan, Ltd.

[57] ABSTRACT

The invention includes the process of shaping a workpiece and for producing a surface contour complementary to the surface contour of a model. The process comprises the steps of applying a masking material to at least a portion of the surface of the workpiece to be shaped, the masking material being adapted to protect the surface from the effects of etchant. A template is then pressed against the surface, the template having a surface contour comprising a negative image of the surface contour to be formed in the workpiece, the template surface being comprised of material adapted to remove the masking material when the template is pressed against the surface and removed from the surface. The template is then withdrawn from the surface to remove masking material from those portions of the surface contacted by the template surface. Etchant is then applied to the surface not covered by the masking material. The steps of pressing the template against the surface to remove masking material and etching the surface of the workpiece are repeated until the surface contour of the workpiece conforms to the surface contour of the model.

34 Claims, 10 Drawing Figures

METHOD FOR SHAPING AND FINISHING A WORKPIECE

This application is a continuation in part from a copending application Ser. No. 30,802, filed on Apr. 17, 1979, abandoned.

FIELD OF THE INVENTION

The present invention relates to a method for shaping and finishing a workpiece, such that the workpiece will have a contour or surface configuration complementary or identical to a model.

BACKGROUND PRIOR ART

In the manufacture of molds and other similar products, or of machined and finished metal parts, wherein it is necessary to form an intricate configuration, maintain close tolerances, or produce highly polished configurations or finished surfaces, the workpiece is commonly machined to produce a rough configuration similar to that required and then hand finished and polished to produce a finished article. For example, in the production of molds of the type for use in injection molding machines or in die casting, wherein it is frequently necessary to form intricate designs or very precise detail in metal and to maintain fine tolerances, manufacture of such products requires machining of the metal to roughly form the mold cavity and then extensive hand polishing. Furthermore, creation of intricate designs in metal is both time consuming and requires an artisan of substantial skill. Since such intricate and extensive manual labor is required for the production of such products, it is generally recognized that the production of molds or other machined finished metal parts is very expensive. Additionally, the requirement of manual creation of intricate designs in metal by hand labor prevents the production of truly identical parts.

SUMMARY OF THE INVENTION

The present invention provides a new process for finishing a workpiece without polishing or other machining and for producing a surface configuration in the workpiece duplicating the surface configuration of the model used to produce the finished metal part.

More particularly, the present invention includes the process of shaping a workpiece and for producing a surface contour complementary to the surface contour of a model. The process comprises the steps of applying a masking material to at least a portion of the surface of the workpiece to be shaped, the masking material being adapted to protect the surface from the effects of etchant. A template is then pressed against the surface, the template comprising a casting produced from the model and having a surface contour comprising a negative image of the surface contour to be formed in the workpiece, the template surface being comprised of material adapted to remove the masking material when the template is pressed against the surface and removed from the surface. The template is then withdrawn from the surface to remove masking material from those portions of the surface contacted by the template surface. Etchant is then applied to the surface of the workpiece to etch portions of the surface not covered by the masking material. The steps of pressing the template against the surface to remove masking material and etching the surface of the workpiece are repeated until the surface contour of the workpiece conforms to the surface contour of the model.

Figure 1:
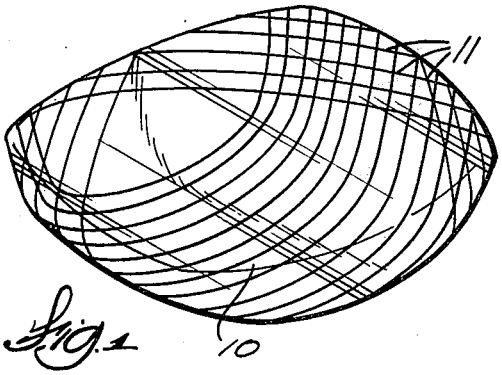
FIG. 1 is a perspective view of a molded street light lens comprising a model for use in construction of a mold for making similar products.

Before describing at least one embodiment of the invention in detail, it is to be understood that the invention is not limited in its application to the details of the process set forth in the following description. The invention is capable of other embodiments and of being practiced and carried out in various ways. Also, it is to be understood that the phraseology and terminology employed herein are for the purpose of description and should not be regarded as limiting.

DESCRIPTION OF A PREFERRED EMBODIMENT

The present invention provides a process for producing finished metal parts and including metal parts of the type having finely polished surfaces, fine tolerances and intricate detail. For example, the process of the present invention can be employed to form and finish mold parts including mold members and mold cores of the type employed in die casting or injection molding wherein the mold cavities may have intricate detail and require finely polished surfaces. While the process of the invention will be recited in connection with production of finished metal parts such as mold members, it should be understood that the invention can also be employed in the production of any other part having a highly defined surface configuration or a highly polished surface. Additionally, the process of the invention should be understood to be applicable to any material such as metals, plastic, ceramic or glass which can be shaped by an etchant or other solvent.

The process of the invention will first be described in connection with the shaping and finishing of a mold cavity of a metal mold of the type for use in the production of die cast or injection molded parts. The model for the mold cavity can comprise either another mold member which is to be duplicated by practicing the process of the invention, or an item to be produced in such a mold member. The process of the invention will first be described in connection with the production of a mold member having a mold cavity therein and wherein an identical original mold member to be duplicated is used as a model. The mold cavity of the model mold member is cleaned with mineral spirits and then alcohol to remove any foreign matter, oil, or grease. The mold cavity is then coated with a suitable release agent such as vaseline, silicone, oil or the like. Air is then blown into the mold cavity of the model to remove any excess release agent and to provide for an evenly distributed thin coating of release agent on the surface of the mold cavity. A cast template or a cast negative image is then made from the clean mold cavity of the model by pouring a castable hardenable material into the mold cavity. While other materials can be employed to form the cast negative image of the mold cavity contour, a room temperature curing urethane has been found to be a suitable material. In preferred forms of the invention, the template can be produced from a room temperature curing urethane such as Flexane 94, produced by Devcon Corporation of Danvers, Mass., or similarly by the use of HR-49 Seal-Peal brand coating material, produced by Seal-Peal, Inc., Troy, Mich. Other materials, such as room temperature vulcanizing rubber, could also be used. If room temperature curing urethane is used to produce the cast template, it is poured into the mold cavity, allowed to cure, and then removed. While the cast template can be cast entirely of urethane, in other forms of the invention wherein the cast template will be relatively large, the mold cavity of the sample mold can first be coated with a layer of urethane, this coating layer allowed to cure, and then the remainder of the mold cavity can be filled with plaster of paris or the like. After the plaster has cured, it can be removed from the urethane layer and a glue or other bonding agent applied to the surface of the urethane. The plaster body can then be reinserted so as to be bonded to the urethane layer. The plaster and urethane template is then removed from the mold cavity of the mold model.

If the process of the invention is employed to produce a mold cavity in a mold member and a model of the product to be molded in such a mold member is employed to provide a form for making a template having a cast negative image of the surface configuration to be formed, the model is cleaned and placed in a suitable confinement or cavity. A room temperature curing urethane, or any other suitable material which can be poured around the material and which will harden to form a mold, is then poured around the model and allowed to cure. In one preferred form of the invention, a suitable material for use in forming the mold around the model is Flexane 30, also produced by Devcon Corporation of Danvers, Mass. After the room temperatured curing urethane has cured, the model of the product to be produced is removed from the urethane mold so formed. The mold cavity of this mold is then coated with a release agent as described above and then the Flexane 94 or Seal-Peal material can be poured into the Flexane 30 mold to thereby product the cast template having a negative image of the surface contour to be formed in the workpiece.

The template so formed is then employed as a form for use in shaping and forming the workpiece by means of a repetitive selective etching process. In a preferred form of the invention, when the process of the invention is to be used to shape and finish a metal block workpiece requiring removal of substantial quantities of metal, for example, in the production of molds having relatively deep mold cavities, it is desirable that the mold block first be machined to pre-form a mold cavity therein, at least roughly, whereby less metal will have to be removed by the repetitive etching process.

The pre-formed mold block is first cleaned with a suitable cleaning agent such as mineral spirits and then alcohol. Those portions of the mold block which are not to be etched, that is, which are intended to be protected from contact with acid, are covered with vinyl tape and/or dyed shellac. The shellac is normally applied to the edges of the tape to prevent acid from getting under the vinyl tape and is also applied to portions of the block which cannot be conveniently taped.

The portion of the workpiece surface, or the pre-formed cavity, which is to be shaped and finished by the application of the repetitive etching process is then coated with a coating or masking material of a type for resisting contact of the etching acid with the metal. While other masking materials can be used, the masking material may comprise re-etching ink, asphaltum varnish, a combination of re-etching ink and asphaltum varnish, or a combination of tar, mineral spirits and lard. Generally, the masking material is brushed or sprayed unto the desired surface of the mold. A suitable re-etching ink is Type 1-B re-etching ink, produced by Sigma Photo Chemical Laboratories of Newton, N.J. A suitable asphaltum varnish masking material is produced by Harold M. Pitman Company, Chicago, Ill. When asphaltum varnish is employed, a suitable viscosity is achieved for application with a paint brush or with a spraying device if 20 parts asphaltum varnish are mixed with 5 parts benzene.

After the surfaces of the workpiece have been coated with the re-etching ink or asphaltum varnish masking material, the cast template is pressed against the coated surface of the workpiece under a slight hand pressure and the pulled away from the coated surface. The surface properties of the urethane template cause that portion of the masking material contacted by the surface of the template to be pulled away from the mold surface. It will be appreciated by those skilled in the art that when the surface of the template is placed against the mold surface, the template surface will engage only portions or high spots of the surface of the mold and, consequently, will pick up only a portion of the removable mold coating material. In order to effectively remove all of the mold coating material from those high spots of the work piece, it is desirable to repetitively press the template against the workpiece to repeatedly pick up the mold masking material from the contacted portions of the surface of the workpiece. In the preferred form of the process, after each pick-up step, the surface of the template is cleaned by wiping the surface with alcohol or benzene. It is preferred that the workpiece and template be supported by a suitable alignment jig assembly so that they will be maintained in alignment with each other during the repeated pick-up steps.

While the cast template has been described as being comprised of Flexane or Seal-Peal, it should be understood that other materials which can be cast to form a self supporting body and which have surface properties which will permit the mold masking material to be suitably pulled away from the mold surface in the manner described, can be used. Similarly, while examples of suitable mold coating materials have been described, it should be understood that materials which are effective to coat the surface of the workpiece to protect it from attack by etching acids, yet which can be selectively removed from the workpiece surface by contact of the template with the coating material, could also be employed.

After a portion of the workpiece masking material has been removed, a suitable etching acid is applied to the work surface. In a preferred form of the invention, the workpiece is dipped in an acid bath. Since the entire workpiece, but for the surface portions contacted by the template, are protected against contact with the acid by vinyl tape, shellac, and the masking material, the acid will remove metal from only those selected portions of the workpiece wherein the coating material was removed by the pick-up process using the template.

While the workpiece may be dipped in various suitable acid baths such as those commonly employed in etching processes, an example of a suitable acid bath is comprised of four parts water mixed with one part 42-BE Nitric Acid produced by McKesson Chemical Company, West Allis, Wis. Another suitable acid bath comprises one gallon of nitric acid mixed with eight ounces of Delboy Sulfuric Acid 66°, produced by McKesson Chemical Co., West Allis, Wis., and four gallons of water. An additional suitable acid bath comprises one gallon of nitric acid, eight ounces of sulfuric acid, one ounce of McKesson Chemical Company Hydrochloric Acid 20° BE and four gallons of water. Another suitable etchant comprises an etchant produced by The Cronite Co., Inc. of North Bergen, N.J., and sold under the name "New Improved Steel Acid".

The length of time a workpiece is subjected to the acid bath is dependent on the amount of material to be removed from the workpiece and the caustic strength of the acid bath.

After the first dipping step, the workpiece is removed from the acid bath, rinsed with water and then cleaned with mineral spirits. If metal deposits have accumulated on the surface of that portion of the workpiece surface being etched, the surface is brushed with a brass brush or otherwise suitably cleaned. The cleaning process is also effective to remove the remaining re-etching ink or asphaltum varnish masking material on the surface of the workpiece. Following the cleaning process, the mold is air dried.

The work surface of the workpiece is then recoated with the re-etching ink, or asphaltum varnish, and the cast negative image is again pressed against the work surface of the workpiece, to pick up selected portions of the masking material from the work surface. Again, only portions of the negative image surface of the template will contact the work surface and, accordingly, only portions of the masking material will be removed from the work surface. While the surface contour of the template and the contour of the work surface will still not meet perfectly, since metal was removed from the workpiece surface during the first acid dipping step, during the second step of picking up coating material from the work surface, the template will tend to fit the contour of the work surface more closely. Accordingly, the surface of the cast negative image will pick up a greater quantity or percentage of the coating material. As during the first pick-up step, it is desirable to repeat the application of the template to the work surface during the second pick-up step to remove as much of the coating material from the work surface as possible.

The workpiece is then dipped again in the acid bath to remove or etch away additional portions of the workpiece material. The workpiece is then again rinsed and cleaned of metal residue and the coating material. As in the previous steps, the work surface is again coated with a coating material after which some of the coating material is removed by repeated applications of the template against the work surface. Since even more of the high spots of the workpiece have been removed, the template will mate more completely with the work surface and will contact an even greater portion of the work surface, thereby removing even more coating material. The remaining coating material is then subjected to a drying step and the etching step is then repeated.

The steps described above are repeated continually until the contour or surface configuration of the workpiece conforms exactly to the surface configuration of the template. This can be determined when the template is completely covered with masking material when pressed against the surface of the workpiece.

In one embodiment of the method of the invention, during the initial step of the process, the workpiece is dipped for relatively long periods of time, for example, one-half to three hours, in acid solutions having a relatively high acid concentration. The work surface, after being subjected to a strong acid concentration for these extended periods of time, will have a relatively rough surface texture. Accordingly, as the shaping and finishing of the work surface nears completion, the workpiece is dipped in a more dilute acid solution and/or for decreasing time periods to thereby produce an improved definition in the work product and a highly polished or finished surface texture.

EXAMPLE

Figure 2:
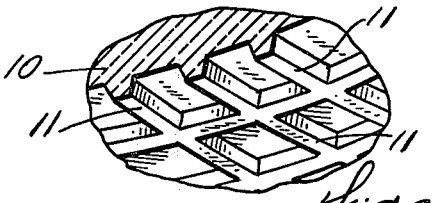
FIG. 2 is an enlarged partial view of a portion of the street light lens shown in FIG. 1.

As an example of the use of the process of the invention, the process may be used to produce a mold cavity in a mold member from a sample article of the type to be molded therein such as the street light lens 10 illustrated in FIGS. 1 and 2, the street light lens 10 having a generally concave lower surface crosshatched with projecting ribs 11. The workpiece 18 (FIG. 3) for use in forming the mold member is first machined to rough out a cavity 20 in the workpiece approximating the shape of the finished cavity. The peripheral portions of the workpiece and those portions which are to be protected from etching, are covered with vinyl tape and shellac. The machined surface 20 of the workpiece is covered with a masking material coating 22 comprising 5 parts benzene per 20 parts asphaltum varnish, the masking material being applied with a paint brush to form a thin, continuous coating on the work surface.

Figure 3:
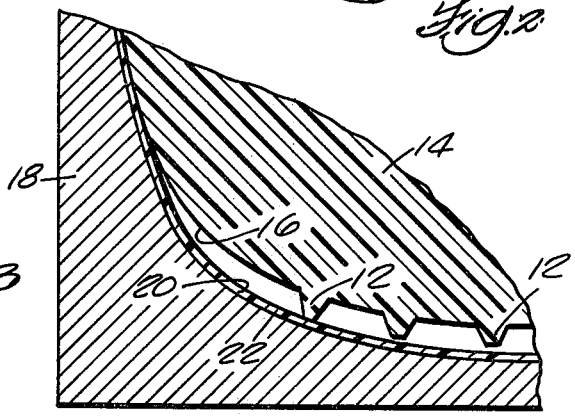
FIG. 3 is a partial cross section elevation view of a template made from the model shown in FIG. 1, the template being pressed into a cavity in a workpiece, the work surface of the workpiece being covered with a masking material.
Figure 4:
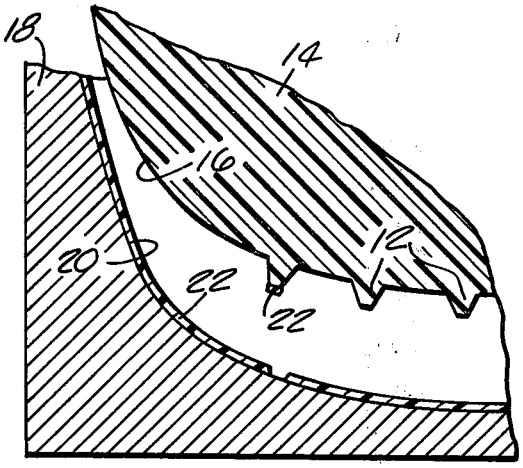
FIG. 4 is a view similar to FIG. 3 but showing the template being withdrawn from the workpiece and removing selected portions of the masking material.
Figure 5:
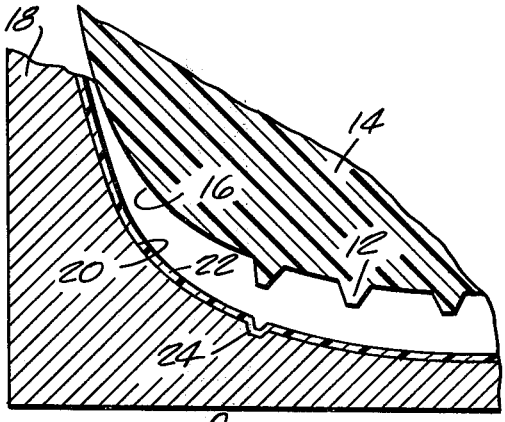
FIG. 5 is a view similar to FIG. 3 but showing the work surface after being subjected to an etchant and recoated with masking material.
Figure 6:
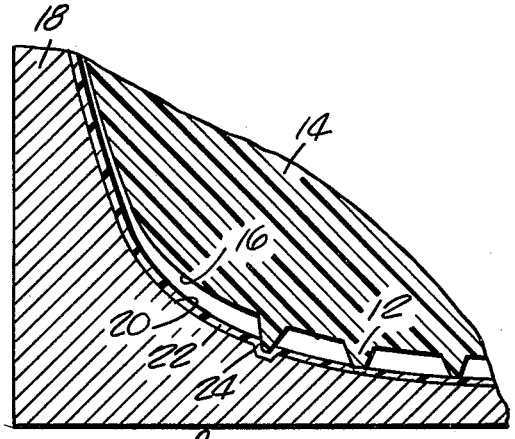
FIG. 6 is a view similar to FIG. 3 but showing the template pressed against the coating of masking material.
Figure 7:
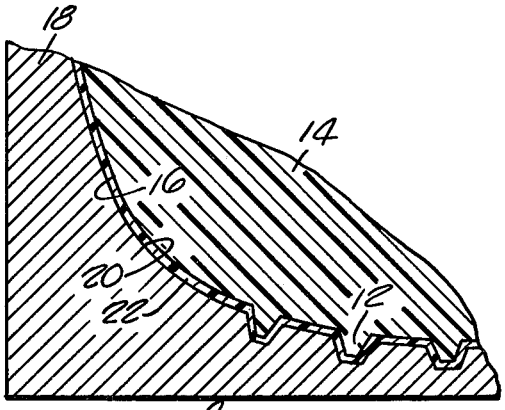
FIG. 7 is a view similar to FIG. 6 but showing the workpiece after repetitive etching steps.

A cast template 14 having a surface 16 with a contour which is a negative image of the surface configuration to be produced in the workpiece 18 is produced from the sample article 10 by first making a mold of the sample article by casting Flexane 30 around the model article and then permitting it to cure. The model 10 is then removed from the Flexane 30 mold, and after being coated by a release agent, the mold is filled with Flexane 94 to form a cast template 14. After the Flexane 94 cures, the template 14 is removed from the Flexane 30 mold. This template 14 is then cleaned and pressed against the coated surface 20 of the workpiece 18 such that projecting portions 12 of the workpiece will pick up selected portions of the asphaltum varnish masking material 22 applied to the work surface 20 as shown in FIGS. 3 and 4. The template 14 is then cleaned and again pressed against the work surface 20 to remove additional masking material 22. After a second cleaning and a subsequent pickup step, the coating material is subjected to a drying step. The workpiece 18 is then ready to be dipped in the etching acid. During the first etching step the workpiece 18 is dipped for 1.5 hours in an aqueous solution of nitric acid as described above and comprised of 4 parts water to 1 part 42-BE nitric acid manufactured by the McKesson Chemical Company. The workpiece 18 is then removed from the acid bath and rinsed with water and then air dried. After this etching step, additional asphaltum varnish is painted over the original masking material layer 22 as shown in FIG. 5. The template 14 is again repeatedly applied against the work surface 20 of the workpiece 18 to remove selected portions of the masking material 20 as shown in FIG. 6. The masking material 22 is then dried and the workpiece 18 is again soaked in the etchant for 1.5 hours and then removed and rinsed with water. The masking material 22 is then removed from the work surface 20 with mineral spirits and, after drying, another layer of masking material 22 is applied to the work surface 20. The template 14 is again pressed against the work surface to remove additional portions of the masking material 22 and, after the masking material 22 has been dried, the workpiece 18 is placed in the acid bath for 1 hour. After this dipping cycle, the workpiece 18 is rinsed and the masking material 22 is removed with mineral spirits. The work surface 20 is then brushed with a brass brush to remove any loose residual metal. After drying, the work surface 20 is recoated with the asphaltum varnish masking material 22 and, after application of the template 14 to the work surface 20 and drying, the workpiece is etched for ½ hour. These steps are repeated and the workpiece is etched for another ½ hour. The workpiece is again cleaned, recoated with the asphaltum varnish, the template reapplied to remove portions of the asphaltum varnish. The masking material 22 is dried and the workpiece is etched for 15 minutes. This process is repeated twice. Following these etching cycles, the workpiece is again cleaned to remove the asphaltum varnish coating material and, after drying, is recoated with the re-etching ink, Type 1-B, produced by Sigma Photo-chemical Laboratories, New Jersey. The template is once again pressed against the work surface to pick up the re-etching ink material contacted by the template and, after drying the re-etching ink, is then etched for 8 minutes. This process is then repeated with the etching time being reduced during successive etching cycles, from 8 minutes to 4 minutes to 2 minutes, and finally, to a 1 minute etching cycle to produce a finished mold cavity, having a surface configuration conforming exactly to that of the model and to the surface contour of the template as shown in FIG. 7.

While the process of the invention has been described in connection with shaping and finishing a cavity in a workpiece, it will be appreciated by those skilled in the art that the process can also be employed to shape and finish the positive contour of products such as mold cores or any other work product commonly produced by machining. To produce a mold core, wherein a sample of the mold core is to be used as a model, a cast template having a surface contour which is a negative image of the surface configuration of the sample mold core may be made by casting a room temperature curing urethane against the sample mold core. The resultant casting will have a cavity therein with a surface contour which is a negative image of the surface contour to be formed in the workpiece. After curing, the cast negative image is separated from the sample core. The workpiece may then be machined to give it a contour roughly approximating that of the sample core. As in the process described above, the surface of the workpiece is then cleaned and covered with a suitable coating material such as asphaltum varnish or re-etching ink. The template can then be forced against the workpiece to remove portions of the masking material from the workpiece, those portions being the surface portions of the workpiece which contact the surface of the template. The workpiece can then be dipped in a suitable etching acid as described above, whereby portions of the metal of the workpiece which are no longer covered by coating material will be removed by the etching acid. This process is then repeated until the workpiece has a surface configuration identical to the complementary surface configuration of the template.

Figure 8:
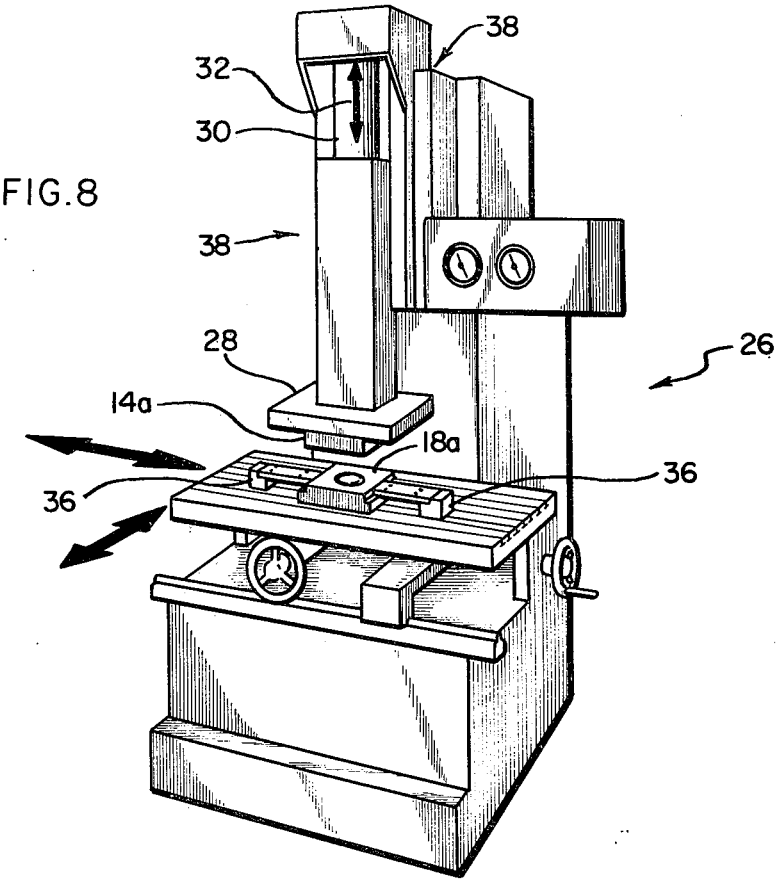
FIG. 8 is a perspective view of an embodiment for maintaining alignment between the template and workpiece.

Turning now to FIG. 8, a means for maintaining alignment between a template **14*a* and a workpiece 18*a* is shown generally as a mechanized alignment jig 26. The template 14*a* is appropriately secured to a platen 28 affixed to a column 30 which moves reciprocally as designed by arrow 32. The jig 26 includes a table 34 having a positive stop member or brackets 36 to securely fasten and align the workpiece 18*a* on the table 34 relative to the platen 28 and template 14*a*. The workpiece 18*a* is easily removed from the brackets 36 for the etching processes and is subsequently replaced in the same location and orientation on the table 34. Accordingly, the jig 26 insures that the surface of the template 14*a* will repeatedly contact the same corresponding surface of the workpiece 18*a***.

As generally shown, a track member 38 aligns the column 30 for reciprocally moving the template **14*a* in a reproducable linear motion to repeatedly contact the workpiece 18*a* in the same location throughout the steps of removing maskant from the workpiece 18*a*. The jig 26 is provided with a suitable limit swith (not shown) to terminate the linear travel at the point of desired contact and pressure between the template 14*a* and the workpiece 18*a***. From the description of the process steps earlier described in detail, the template will be progressively moved in accordance with the degree of etching or reproduction of the surface contours of the template into the workpiece surface.

Figure 9:
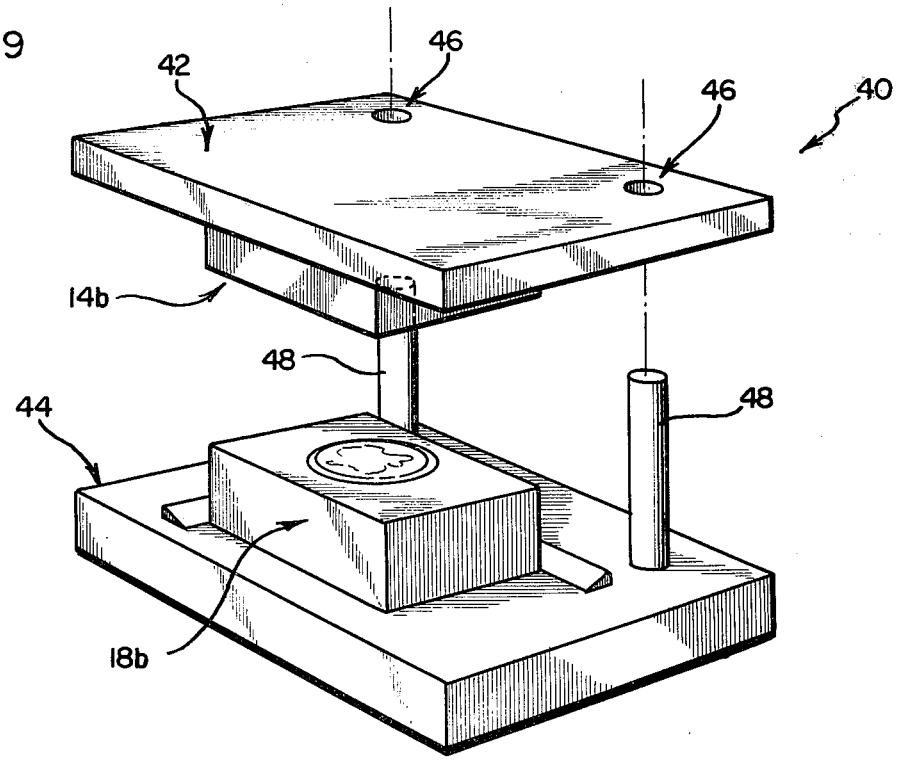
FIG. 9 is a perspective view of another embodiment for maintaining alignment between the template and workpiece.

FIG. 9 illustrates another embodiment, such as die set 40, for maintaining alignment between template **14*b* and workpiece 18*b*. The die set 40 includes platens 42 and 44 having cooperating aperatures 46 and shafts 48. Although not shown, it will be understood that die set 40 may be hand operated in a suitable alignment jig or any suitable linear press which will reproducably maintain the alignment between the template and workpiece throughout steps of pressing the template against the workpiece to selectively adhere and remove masking material from the workpiece. Oftentimes it will be preferable to orient the die set 40** for horizontal linear movement to facilitate the cleaning of and the inspection of the template by the operator during the steps of selectively adhering maskant to the template.

The present invention is employed to reproduce the contours or surface textures of numerous models having very shallow or very pronounced heights and depths.

From the description set forth above, models having a texturized or shallow surface contour, such as woodgrain, leather, or other similar surfaces, are reproduced by casting a template having the negative image, nonplanar surface contour of the model to be formed in the workpiece in the same manner as set forth above. The cast rubber or rubber-like template will reproduce the texturized or non-planar image regardless of the height and depth of the model contour.

Figure 10:
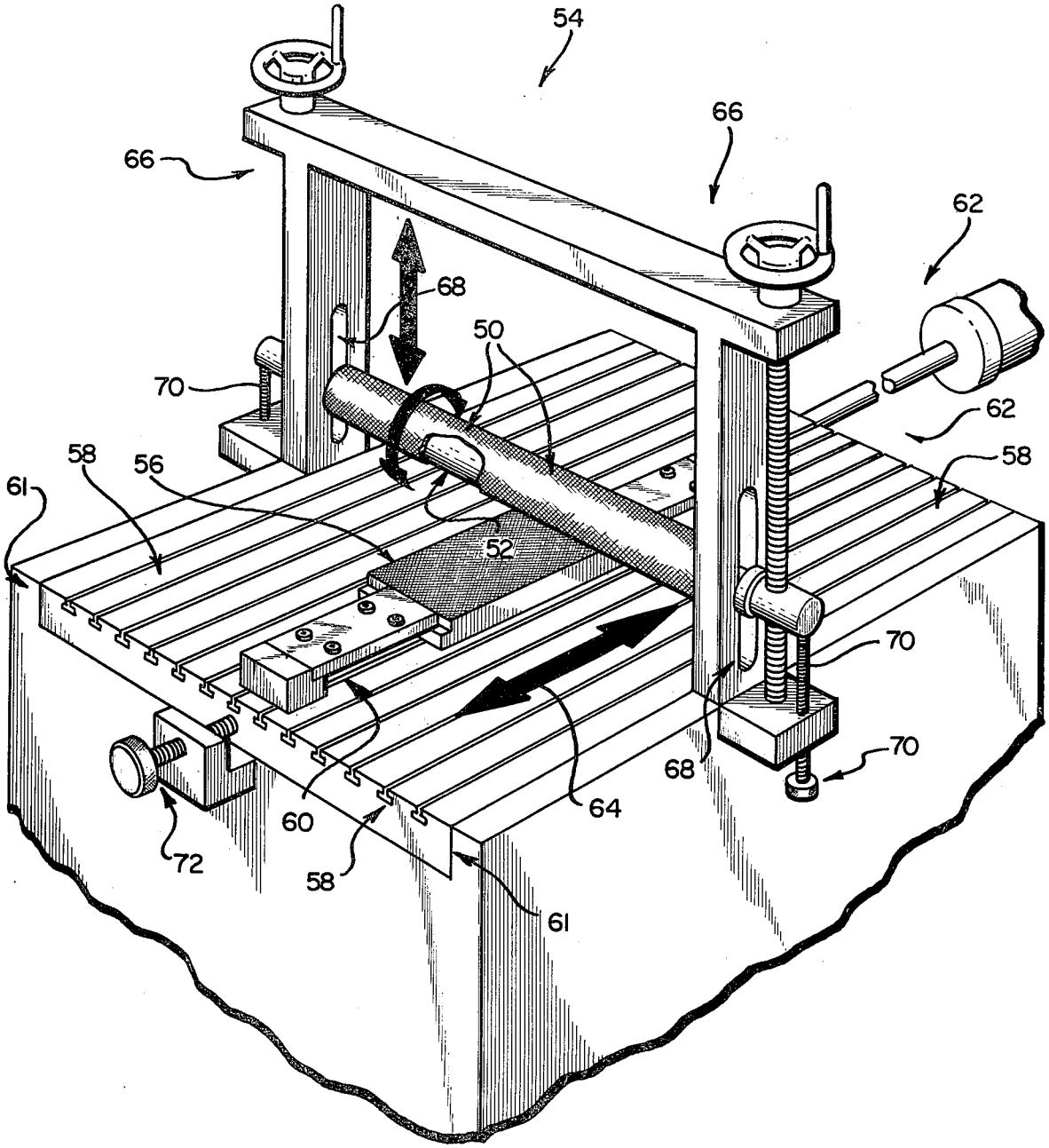
FIG. 10 is a perspective view of an embodiment of the invention shown with a cylindrical template and an assembly for maintaining alignment between the workpiece and template.

FIG. 10 shows another embodiment of the invention and includes a template 50 which has been wrapped and secured around a cylinder 52. As shown generally, the template 50 assumes the configuration of the cylinder and is provided with an alignment means 54 to maintain the orientation of the template 50 relative to a workpiece 56. The alignment means 54 includes an adjustable table 58 and brackets 60 to secure the workpiece 56 in a fixed position. The table 58 is supported by and reciprocally movable within a frame 61 by an appropriate means 62 for movement illustrated by arrow 64. A bracket member 66 supports the roller 52 within adjustable track member 68 enabling adjustment of the roller 52 towards and away from the workpiece 56. Appropriate adjustable, positive stop members 70 are provided on both sides of the track 68 to reproducably control the distance between the cylindrical template 50 and the workpiece 56. The template 50 is positioned to contact the workpiece 56, coated with the maskant material, with the table 58 in a starting position. The starting position is set by a micro-adjustable stop member 72. From the starting position, the table is moved in a linear stroke causing the surface of the template 50 to roll over the surface of the workpiece 56. At the end of each stroke, the cylinder may be raised and the table returned and if desired, the surface of the template 50 may be cleaned. The table 58 and workpiece 56 are returned to the position determined by stop 72 and the cylinder 52 is lowered. The template 50 is reproducably rolled over the workpiece 56 for as many times as desired to remove maskant as more fully described above. The workpiece 56 is readily removed from the table 58 for etching and returned to the same location within the brackets.

Other arrangements of the cylindrical template and means for reproducably maintaining alignment between the template and workpiece may be employed. One such embodiment, not shown, would be to maintain the workpiece in a stationary position, for example on a magnetic table, and move the roller across the stationary surface of the workpiece. To maintain reproducability of the path of contact between the surfaces of the template and workpiece, it is critical that the starting point of contact between the template and the workpiece be accurately duplicated. Accordingly, the surface of the template repetitively contacts the surface of the workpiece at the same relative locations during the repetitive removal of maskant steps.

A cylindrical template may be preferred for those applications requiring the reproduction of non-planar, shallow surface texturizing into a large workpiece surface. The cylindrical template eliminates some of the difficulties of supporting and inspecting a linear template having a large surface area.

Various features of the invention are set forth in the following claims.

I claim:

1. A process for shaping a workpiece and for producing a workpiece surface contour complementary to the surface contour of a model desired to be reproduced, the process comprising the steps of:

(a) providing a non-planar template which is a negative image of the workpiece surface contour to be reproduced;

(b) applying a coating of an etchant resistant masking material to at least a portion of the surface of said workpiece, said masking material being adapted to protect said workpiece surface from the effects of etchant;

(c) pressing said template against said workpiece surface;

(d) withdrawing said template from said workpiece surface to selectively adhere the masking material to the template and correspondingly selectively remove masking material from those portions of said workpiece surface contacted by said non-planar template surface;

(e) applying etchant to said workpiece surface to etch portions of said workpiece surface not covered by said masking material; and (f) repeating steps (b) through (e) until the surface contour of the workpiece conforms to the nonplanar surface contour of the model.

2. A process as set forth in claim 1 wherein following the step of withdrawing said template, the process further includes the steps of cleaning said template of said masking material, and repeating said steps of pressing said template against said workpiece surface, withdrawing said template and cleaning said template of masking material until said template ceases to remove appreciable quantities of said masking material from said workpiece surface.

3. A process as set forth in claim 2 wherein following said steps of applying etchant, said process further includes the steps of cleaning said workpiece surface to thereby remove said masking material and recoating said workpiece surface with said masking material.

4. A process as set forth in claim 1 wherein said template is comprised of cast room temperature curing uethane.

5. A process as set forth in claim 1 wherein said step of applying a masking material to said metal workpiece includes the application of a coating of re-etching ink to said workpiece surface.

6. A process as set forth in claim 1 wherein said step of applying a masking material to said workpiece surface includes the application of asphaltum varnish to said workpiece surface.

7. A process as set forth in claim 1 wherein said workpiece includes a preformed cavity therein, said cavity having an internal surface, and wherein said coating material is applied to said preformed cavity surface.

8. A process as set forth in claim 1 and further including the step of covering portions of said workpiece to be protected from attack by acid with a protective covering of shellac.

9. A process as set forth in claim 1 wherein said step of applying etchant to said workpiece surface includes dipping said workpiece in an aqueous acid solution.

10. A process as set forth in claim 1 wherein after withdrawing of said template from said workpiece surface and before said step of applying acid to said workpiece surface, the process further includes th step of cleaning said template to remove coating material therefrom and placing said template against said workpiece surface to remove additional amounts of said coating material from said workpiece surface.

11. A process as set forth in claim 1 wherein, following said steps of applying etchant, said process further includes the steps of cleaning said workpiece surface to thereby remove masking material and recoating said surface with masking material.

12. A process as set forth in claim 1 wherein said model has a surface contour which is a positive image of the surface contour to be produced in said workpiece and further including the step of casting a hardenable material against the surface of said model to form said template.

13. A process as set forth in claim 1 wherein following the step of withdrawing said template, the process further includes the steps of cleaning said template of said masking material, and repeating said steps of pressing said template against said workpiece surface, withdrawing said template and cleaning said template of masking material until said template ceases to remove appreciable quantities of said masking material from said workpiece surface.

14. A process as set forth in claim 13 wherein, following said steps of applying etchant, said process further includes the steps of cleaning said surface to thereby remove said masking material and recoating said surface with said masking material.

15. A process as set forth in claim 12 wherein said template is comprised of cast room temperature curing urethane.

16. A process as set forth in claim 12 wherein said step of applying a masking material to said workpiece includes the application of a coating of re-etching ink to said workpiece surface.

17. A process as set forth in claim 12 wherein said step of applying a masking material to said workpiece surface includes the application of asphaltum varnish to said workpiece surface.

18. A process as set forth in claim 12 wherein said workpiece includes a preformed cavity therein, said cavity having an internal surface, and wherein said coating material is applied to said preformed cavity surface.

19. A process as set forth in claim 12 and further including the step of covering portions of said workpiece to be protected from attack by acid with a protective covering of shellac.

20. A process as set forth in claim 12 wherein said step of applying etchant to said workpiece surface includes dipping said workpiece in an aqueous acid solution.

21. A process as set forth in claim 12 wherein, following said steps of applying etchant, said process further includes the steps of cleaning said workpiece surface to thereby remove masking material and recoating said workpiece surface with masking material.

22. A process as set forth in claim 1 wherein said model has a surface contour which is a negative image of the surface contour to be produced in said workpiece and further including the steps of casting a hardenable material against the surface contour of said model to form a mold, casting a hardenable material in said mold to form said template, and separating said template from said mold.

23. A process as set forth in claim 22 wherein following the step of withdrawing said template, the process further includes the steps of cleaning said template of said masking material, and repeating said steps of pressing said template against said workpiece surface, withdrawing said template and cleaning said template of masking material until said template ceases to remove appreciable quantities of said masking material from said workpiece surface.

24. A process as set forth in claim 22 wherein, the following said steps of applying etchant, said process further includes the steps of cleaning said workpiece surface to thereby remove said masking material and recoating said workpiece surface with said masking material.

25. A process as set forth in claim 22 wherein said templates is comprised of cast room temperature curing urethane.

26. A process as set forth in claim 22 wherein said step of applying a masking material to said metal workpiece includes the application of a coating of re-etching ink to said workpiece surface.

27. A process as set forth in claim 22 wherein said step of applying a masking material to said workpiece surface includes the application of asphaltum varnish to said workpiece surface.

28. A process as set forth in claim 22 wherein said workpiece includes a preformed cavity therein, said cavity having an internal surface, and wherein said coating material is applied to said preformed cavity surface.

29. A process as set forth in claim 22 and further including the step of covering portions of said workpiece to be protected from attack by acid with a protective covering of shellac.

30. A process as set forth in claim 22 wherein said step of applying etchant to said workpiece surface includes dipping said workpiece in an aqueous acid solution.

31. A process as set forth in claim 22 wherein, following said steps of applying etchant, said process further includes the steps of cleaning said workpiece surface to thereby remove masking material and recoating said workpiece surface with masking material.

32. A process as set forth in claim 1 further including the step of maintaining the template in alignment with the workpiece.

33. A process as set forth in claim 32 wherein said step of maintaining alignment includes orienting the template to the workpiece to thereby linearly and repeatedly contact the same portions of the template and the workpiece surface during the pressing and withdrawing steps.

34. A process as set forth in claim 32 wherein said pressing and withdrawing steps include rolling the template across the workpiece surface.

* * * * *